United States Patent [19]

Wasko

[11] 4,090,279

[45] May 23, 1978

[54] SEPARABLE SLIDE FASTENER

[75] Inventor: George Wasko, Meadville, Pa.

[73] Assignee: Textron Inc., Providence, R.I.

[21] Appl. No.: 758,324

[22] Filed: Jan. 10, 1977

[51] Int. Cl.[2] ..... A44B 19/36

[52] U.S. Cl. ..... 24/205.11 F; 24/205 R

[58] Field of Search ..... 24/205.11 R, 205.11 F

[56] References Cited

U.S. PATENT DOCUMENTS

| | | | |
|---|---|---|---|
| 2,267,384 | 12/1941 | Waldes | 24/205.11 R |
| 2,273,773 | 2/1942 | Poux | 24/205.14 R |
| 3,377,668 | 4/1968 | Carlile | 24/205.11 F |
| 3,858,283 | 1/1975 | Runnels | 24/205.11 R |

FOREIGN PATENT DOCUMENTS

| | | | |
|---|---|---|---|
| 2,010,269 | 9/1971 | Germany | 24/205.11 F |
| 542,748 | 5/1956 | Italy | 24/205.11 R |

*Primary Examiner*—Bernard A. Gelak

*Attorney, Agent, or Firm*—O'Brien & Marks

[57] ABSTRACT

A separable slide fastener is disclosed which utilizes two oppositely-oriented sliders, both of the sliders being of the locking type. Bottom stops are provided at the bottom of the slide fastener and a one of the bottom stops has a channel formed in it to accommodate the locking prong of the lower slider and cammed surfaces to allow the pin side of the bottom stop to be drawn through the slider to separate the slide fastener.

2 Claims, 4 Drawing Figures

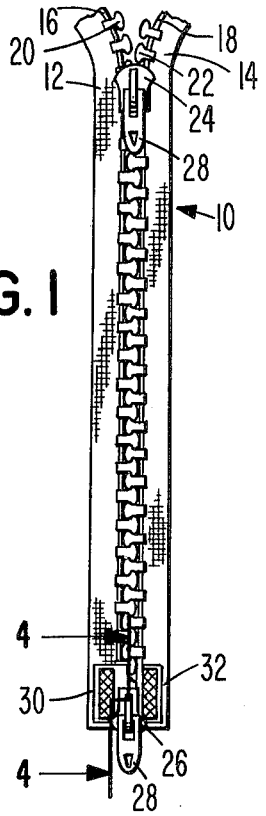
FIG. 1
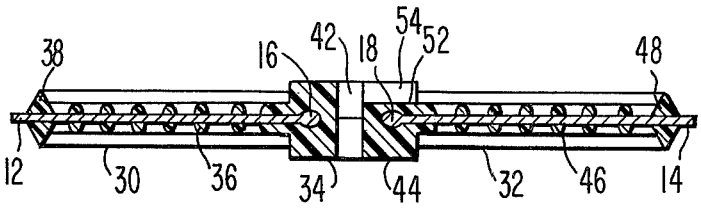
FIG. 3
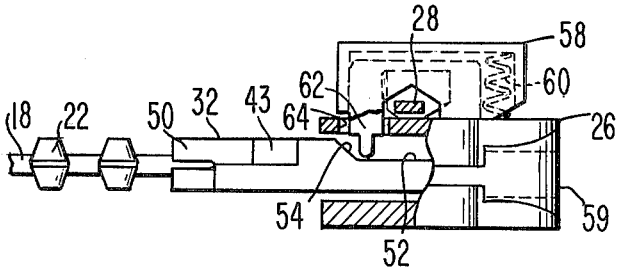
FIG. 4
FIG. 2
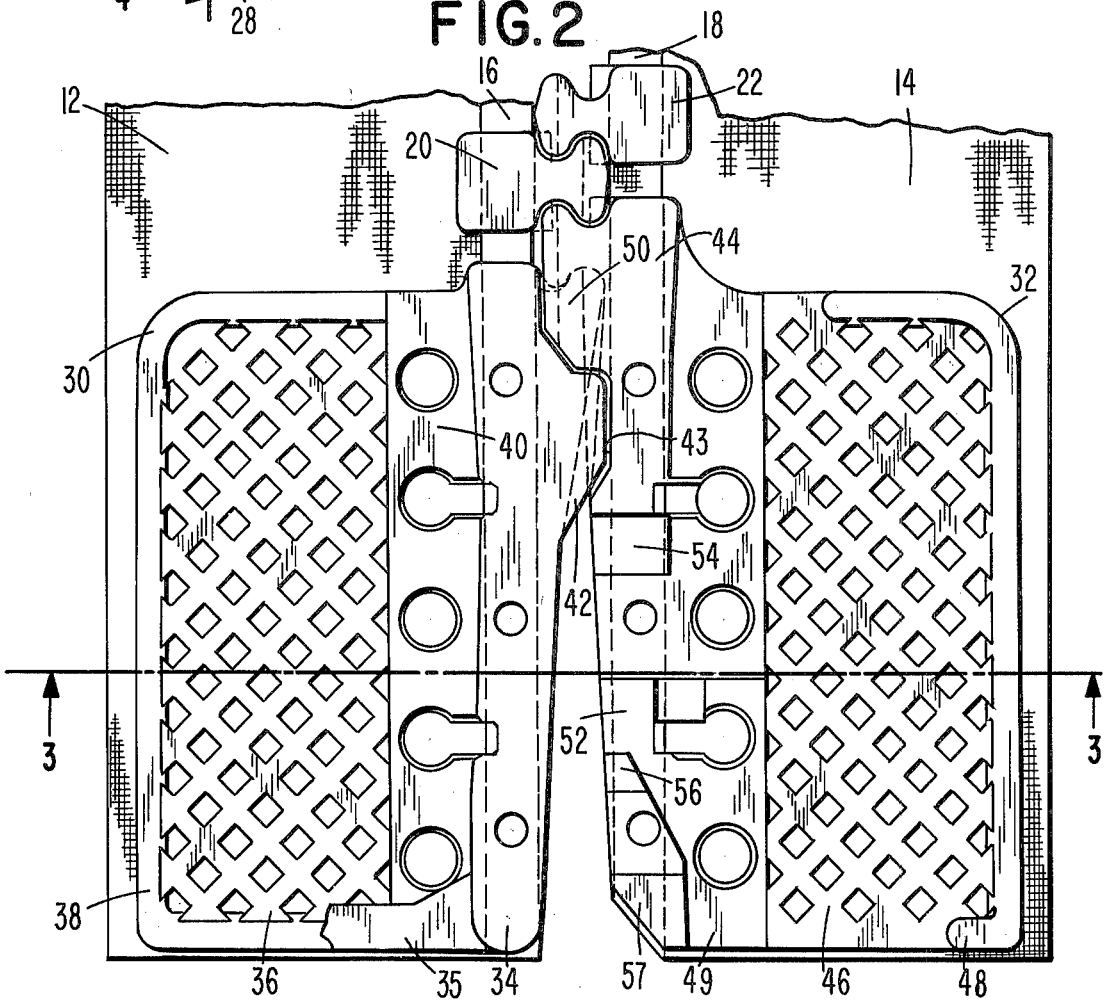

SEPARABLE SLIDE FASTENER

BAKCKGROUND OF THE INVENTION

1. Field of the Invention

The present invention relates to separable slide fasteners and in particular to separable slide fasteners having two sliders so that the slide fastener may be opened from either the top or the bottom.

2. Description of the Prior Art

Separable slide fasteners are well known to the prior art as exemplified by U.S. Pat. No. 3,922,761. The prior art is also generally cognizant of the use of separable slide fasteners including two oppositely directed sliders, such as that shown by U.S. Pat. No. 2,553,230. It has been a problem in such slide fasteners that at least the lower of the two sliders cannot be of the locking type since the locking means of the lower slider would interfere with the easy separation of the two parts of the separable slide fastener.

It has also been proposed to include in the bottom stop of a one slider fastener a provision to retain the slider in place. U.S. Pat. No. 3,858,283 discloses a slide fastener in which a locking prong of the one slider is received in a notch cut in tubular part of a separable slide fastener to retain the slider in position during separation.

SUMMARY OF THE INVENTION

The present invention is summarized in that a separable slide fastener includes first and second mounting tapes disposed adjacent each other; a series of slide fastener coupling elements formed along the edge of each of the tapes adjacent the opposite tape; first and second sliders entrained on the coupling elements and movable along the slide fastener to selectively engage and disengage the coupling elements of the two tapes, the first slider being oriented in an upward direction and the second slider being oriented in a downward direction; a pull tab for each slider; spring biased locking means on each of the sliders to engage the coupling elements to prevent movement of the slider, pulling of the pull tab of each slider disengaging the locking means to allow the slider to move; a respective bottom stop formed on both sides of the bottom portion of each of the tapes; a pin side of each bottom stop formed along the edge of the tape adjacent the opposite tape, the pin sides receiving the sliders when the sliders are moved to the bottom stops; a first of the pin sides having a locking means channel defined in it so as to receive the locking means of the second slider when the second slider is positioned over the bottom stops; a first canted cam surface formed in the first pin side to define the lower limit of the channel; and a second canted cam surface formed on the lowermost end of the first pin side, said first and second canted cam surfaces being positioned to engage the locking means on the second slider to allow the first pin side to be withdran therefrom to separate the tapes.

It is an object of the present invention to provide a separable slide fastener which includes two oppositely oriented sliders in which both of the sliders have provision for automatically locking in place on the slide fastener.

It is another object of the present invention to construct such a separable slide fastener in which a provision is made to retain the lower slider in position when it is positioned on the bottom stops of the slide fastener.

It is yet another object of the present invention to provide such a slide fastener wherein the bottom stop can be easily drawn through the sliders without hinderance from the locking means on the lower slider.

Other objects, advantages and features will become apparent from the following specification when taken in conjunction with the accompanying drawings.

BRIEF DESCRIPTION OF THE DRAWINGS

FIG. 1 is a plan elevation view of a slide fastener constructed according to the present invention.

FIG. 2 is an enlarged view of the bottom stops of the slide fastener of FIG. 1.

FIG. 3 is a cross section along the line 3—3 in FIG. 2.

FIG. 4 is a cross section along the line 4—4 in FIG. 1.

DESCRIPTION OF THE PREFERRED EMBODIMENT

As shown in FIG. 1, the present invention is embodied in a slide fastener generally indicated at 10. The slide fastener 10 includes a pair of mounting tapes 12 and 14 disposed adjacent each other with each of the tapes 12 and 14 having a respective bead cord 16 and 18 formed along its edge adjacent the other tape. A series of thermoplastic slide fastener coupling elements 20 and 22 are mounted on the bead cords 16 and 18 along the edges of the tapes 12 and 14. A pair of oppositely-oriented automatically locking sliders 24 and 26 are slidably entrained on the coupling elements 20 and 22 with the upwardly directed slider 24 serving to disengage and engage the coupling elements 20 and 22 from the top of the slide fastener 10 while the downwardly directed slider 26 moves to disengage and engage the coupling elements 20 and 22 from the bottom of the slide fastener. Each of the sliders 24 and 26 has a pull tab 28 mounted thereon so that they may be manually pulled up and down the slide fastener.

A pair of thermoplastic bottom stops 30 and 32 are molded onto both sides of the respective bottom portions of the tapes 12 and 14, the bottom stops 30 and 32 being shown in additional detail in FIGS. 2 and 3. The bottom stop 30 has formed along its edge adjacent the bottom stop 32 a thickened pin side 34 which extends the length of the bottom stop 30 and which has a generally rectangular cross-section. The bottom stop 30 is positioned relative to the tape 12 so that the pin side 34 is molded around the cord bead 16. Extending laterally outward from the bottom edge of the pin side 34 is a slider stop 35 formed as a raised rib along the bottom edge of the bottom stop 30. The bottom stop 30 is largely made up of a network of stiffening ribs 36 which are formed on both surfaces of the tape 12 in a cross-hatch pattern. A peripheral rib 38 is formed around the edge of the bottom stop 30 on both sides of the tape 12 to define the outermost edges of the bottom stop. A slider shelf 40 extends outward from the pin side 34 into the area of the stiffening ribs 36 to support the sliders 24 and 26 when they are positioned over the bottom stop 30.

A projection 42 extending from the pin side 34 is sized so as to interfit in a recess 43 provided in a pin side 44 formed along the edge of the bottom stop 32. The bottom stop 32 is positioned so that the pin side 44, which is molded onto both sides of the tape 14, is centered around the cord bead 18. Extending outward from the pin side 44 is a network of stiffening ribs 46 which are formed on to both sides of the tape 14. A peripheral rib 48 is formed around the edge of the bottom stop 32 again on both sides of the tape 14 to define the edge of the bottom stop. A slider shelf 49 is provided extending from the pin side 44 into the area of the stiffening ribs 46 to support the sliders 24 and 26 when they are positioned over the bottom stop 32. Formed on the upper outside edge of the pin side 44 is a special coupling element 50 which has surfaces shaped to engage both the projection 42 of the pin side 34 and the first of the coupling elements 20 to interlock therewith. The special coupling element 50 is integrally formed onto the pin side 44.

Formed as a cut-out section of the upper side of the pin side 44 there is provided a locking prong channel 52. The channel 52 is cut from the upper surface of the pin side 44 so that the bottom of the channel 52 is even with the top surface of the slider shelf 49. The upper end of the channel 52 is defined by a canted cam surface 54 which slopes from the top surface of the pin side 44 down to the bottom of the channel 54. The lower end of the channel 52 is formed by a canted cam surface 56 which linearly slopes from the bottom of the channel 52 back up to the upper surface of the pin side 44. The lowermost end of the pin side 44 has formed in its upper side a canted cam surface 57 which slopes downward to terminate the top side of the pin side 44 below the channel 52 in a slanted surface.

Some details of the slider 26 can be seen in FIG. 4. For further details of this slider, reference should be made to U.S. Pat. No. 3,858,283, the disclosure of which is hereby incorporated herein by reference, which discloses a slide fastener utilizing a slider, therein identified with reference numberal 20, identical to both the sliders 24 and 26 in the slide fastener 10 of the present invention.

As shown in FIG. 4, the automatic lock of the slider 26 includes a housing 58 pivotally mounted to a slider body 59. A spring 60 is secured between the front end of the housing 58 and the top surface of the slider body 59 to constantly urge the forward end of the housing 58 upward and its rear downward. Along the rear upper surface of the slider body 59 there is provided a slot 64, which is positioned so as normally to be directly in line along the cord bead 18 when the slider 26 is in position over the coupling elements 20 and 22. A locking prong 62 projects downward from the rearmost end of the housing 58 and into and through the slot 64. A crossbar of the pull tab 28 extends underneath the housing 58 just forward of the locking prong 62. The slider 24 is identical to the slider 26, and the descriptions of the features of the slider 26 herein should apply equally to the slider 24.

In its operation, the slide fastener 10 will normally appear in its closed configuration as it is shown in FIG. 1. The coupling elements 20 and 22 can be disengaged in series starting from the top if the slider 24 is pulled downward by pulling on the pull tab 28 attached thereto. The coupling elements can be re-engaged starting upward by pulling the slider 24 upward. To perform a similar function starting at the bottom of the slide fastener 10, the slider 26 is pulled upward by its pull tab 28. The slider 26 as it moves upward first separates the special coupling element 50 from the first of the coupling elements 20 and then successively also disengages the coupling elements 20 and 22. Similarly, the coupling elements 20 and 22 can be re-engaged in a downward progression by moving the slider 26 downward ending with the re-engagement of the special coupling element 50 and the first coupling element 20. The downward movement of the slider 26 along the slider shelves 40 and 49 of the bottom stops 30 and 32 is checked at the very bottom of the slide fastener 10 by the slider stop 35 on the bottom stop 30 which is designed so as to be large enough so that it will not allow the slider 26 to pass over it.

When not being pulled, each of the sliders 24 and 26 is automatically fixed in position by the locking prong 62 which projects between the coupling elements 20 and 22 to hold the slider in place. Pulling of the pull tab 28 of either slider pivots the housing 58 against the spring 60 to pull the locking prong 62 upward to allow the slider to move.

To completely separate the tapes 12 and 14 from each other, the slider 26 is first brought down to its lowermost position against the slider stop 35. Then the slider 24 is pulled downward separately all the coupling elements 20 and 22 to its lower most position wherein its rear end abuts the rear end of the slider 26, both sliders now being entrained on the pin sides 34 and 44. The bottom stop 32 is then lifted upward with the pin side 44 being lifted out of and away from the sliders 24 and 26. To rejoin the two halves of the slide fastener, the pin side 44 is re-inserted into the sliders 24 and 26 and the slider 24 is pulled upward to rejoin the coupling elements 20 and 22.

As can be seen in FIG. 4, the locking channel 54 is located on the pin side 44 so as to receive the locking prong 62 of the slider 26 when the slider 26 is pulled to its lowestmost position along the slide fastener 10. The slider 26 will tend to remain at this position without movement inasmuch as the locking prong 62 tends to remain in the channel 52. The slider 26 can also be automatically locked in place at any other location along the slide fastener 10 as the locking prong fits between a pair of the coupling elements 22.

The canted cam surfaces 56 and 57 allow the use of the locking prong 62 on the slider 26 while still allowing the havles of the slide fastener 10 to be separable from each other. To separate the tapes 10 and 12 entirely, the slider 26 must be in its lowermost position against the slider stop 35 and the slider 24 must be pulled all the way down the slide fastener 10, separating the coupling elements 20 and 22 until it rests against the slider 26. Both of the sliders are then entrained on the pin sides 34 and 44. The bottom stop 32 is then lifted to pull the pin side 44 upward through the sliders 24 and 26 to separate the halves of the slide fastener. As the pin side 44 is lifted through the slider 26, the canted cam surface 56 contacts the locking prong 62 of the slider 26 and cams it upward to allow the lower part of the pin side 44 to clear the locking prong. To re-engage the halves of the slide fastener 10, the bottom stop 32 is manipulated so that the pin side 44 is inserted into the sliders 24 and 26 which now are entrained only on the pin side 34. As the pin side 44 progresses into the sliders, the canted cam surface 57 will contact the locking prong 62 to cam it upward to allow the bottom part of the pin side 44 to clear the locking prong. Once the pin side 44 is pulled even with the pin side 34, the slider 24 can be pulled upward to reclose the slide fastener 10.

Thus the provision of the locking channel 52 allows for the use of a locking slider for the lower slider 26 on a two-slider separable slide fastener such as the slide fastener 10 herein. By providing such a channel it is ensured that the slider 26 will remain on the bottom stops 30 an 32 and will be resistant to movement away from its normal position unless, of course, the pull tab 28 is pulled to retract the locking prong 62. The canted cam sufaces 56 and 57 allow the pin side 44 to be retracted from and reinserted in the sliders on the slide fastener by automatically camming upward the locking prong. This obviates any need for any manipulation of the pull tab 28 during the separation or re-insertion procedures, which would otherwise be an awkward and difficult procedure.

Inasmuch as the present invention is subject to many modifications, variations, and changes in detail, it is intended that all the subject matter in the foregoing description or in the accompanying drawings be interpreted as illustrative, and not in a limiting sense.

What is claimed is:

1. A separable slide fastener comprising first and second mounting tapes disposed adjacent each other;

a series of slide fastener coupling elements formed along the edge of each of the tapes adjacent the opposite tape;

first and second sliders entrained on the coupling elements and movable along the slide fastener to selectively engage and disengage the coupling elements of the two tapes, the first slider being oriented in an upward direction and the second slider being oriented in a downward direction;

a pull tab for each slider;

spring biased locking means on each of the sliders to engage the coupling elements to prevent movement of the slider, pulling of the pull tab of each slider disengaging the locking means to allow the slider to move;

a respective bottom stop formed on both sides of the bottom portion of each of the tapes;

a pin side on each bottom stop formed along the edge of the tape adjacent the opposite tape, the pin sides receiving the sliders when the sliders are moved to the bottom stops;

each bottom stop including a network of reinforcing ribs on each side of the tape and a slider shelf extending outward from the pin side into reinforcing ribs;

a first of the pin sides having a locking means channel defined in it so as to receive the locking means of the second slider when the second slider is positioned over the bottom stops;

the channel being sized so that its bottom is even with the slider shelf of the bottom stop;

a first canted cam surface formed in the first pin side to define the lower limit of the channel; and a second canted cam surface formed on the lowermost end of the first pin side, said first and second canted cam surfaces being positioned to engage the locking means on the second slider to allow the first pin side to be withdrawn therefrom to separate the tapes.

2. A separable slide fastener as claimed in claim 1 wherein the locking means on each of the sliders includes a housing pivotally mounted on the housing, a spring to bias the housing, and a locking prong depending downward from the housing and biased downward by the spring.

* * * * *